US005567889A

United States Patent [19]

Sullivan et al.

[11] Patent Number: 5,567,889

[45] Date of Patent: Oct. 22, 1996

[54] LYSIMETER FOR COLLECTING CHEMICAL SAMPLES FROM THE VADOSE ZONE

[75] Inventors: Patrick K. Sullivan; Dayananda Vithanage; Robert E. Bourke, all of Honolulu, Hi.

[73] Assignee: Oceanit Laboratories, Inc., Honolulu, Hi.

[21] Appl. No.: 465,560

[22] Filed: Jun. 5, 1995

Related U.S. Application Data

[62] Division of Ser. No. 873,161, Apr. 24, 1992.

[51] Int. Cl.[6] ..... G01N 1/20

[52] U.S. Cl. ..... 73/863.23; 23/863.52; 23/864.51; 23/864.31; 23/864.33

[58] Field of Search ..... 73/863.23, 863.51, 73/863.52, 863.57, 864.31, 864.33, 864.51, 864.73

[56] References Cited

U.S. PATENT DOCUMENTS

| | | | |
|---|---|---|---|
| 3,240,067 | 3/1966 | Jongejan | 73/863.23 |

FOREIGN PATENT DOCUMENTS

| | | | |
|---|---|---|---|
| 795533 | 10/1968 | Canada | 73/863.23 |
| 155027 | 5/1992 | Japan | 73/863.23 |
| 638864 | 12/1978 | U.S.S.R. | 73/863.23 |

*Primary Examiner*—Hezron E. Williams
*Assistant Examiner*—Daniel S. Larkin
*Attorney, Agent, or Firm*—James Creighton Wray

[57] ABSTRACT

A lysimeter has an elongated, relatively narrow sample pipe with flanges at upper and lower ends. A lysimeter assembly is connected to the lower end of the sample pipe by connecting an upper end of a central tube in the assembly to a lower end of the sample pipe. A circular lysimeter pan extends around the central tube. Vertical slits in the central tube provide a screen to permit water flow into the central tube from the pan but to prevent granular materials from the filter pack. Vertical webs in the pan rigidify the pan, and radial supporting webs and a ring beneath the pan support the pan. A relatively large diameter collection chamber has a spheroidal lower end and an upper end which receives the ring for centering the lysimeter pan at the upper end of the collection chamber. An outward and upward sloping flange at an upper end of the collection chamber with an elastic seal supports the lower conical wall of the lysimeter pan. A wick in the pan extends through slits in the central tube to wick water from the pan into the central tube and to flow water down along the inner wall of the central tube. The bottom of the central tube is open and is sloped, and an upward opening inner groove is formed around the lower end of the central tube. A drain tube is connected to a lower portion of the groove. A sampler is raised and lowered and positioned by a rod or chain extending through the sample pipe and central tube, so that a funnel at the upper end of a flask is aligned with the drain tube. Drain openings are provided in the canister bottom.

2 Claims, 4 Drawing Sheets

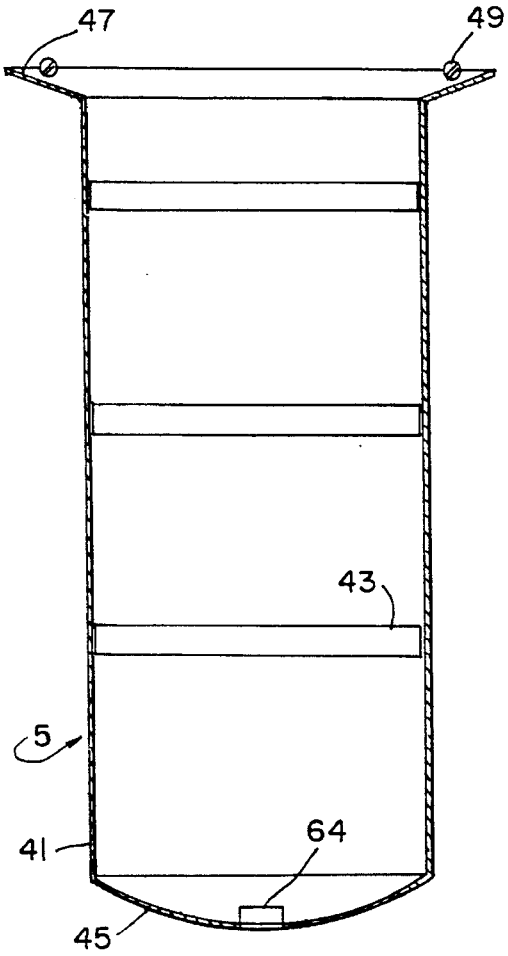
FIG. 3A
FIG. 3B
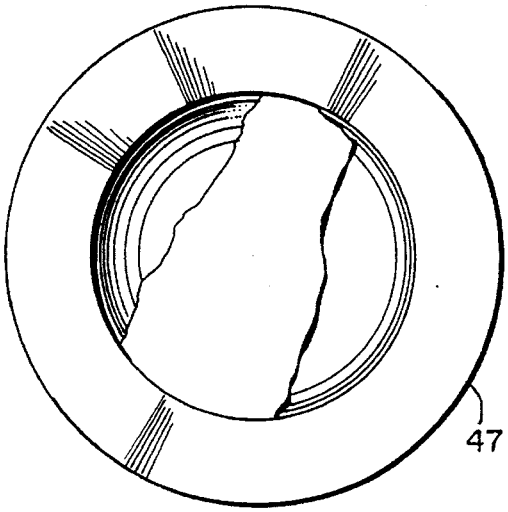
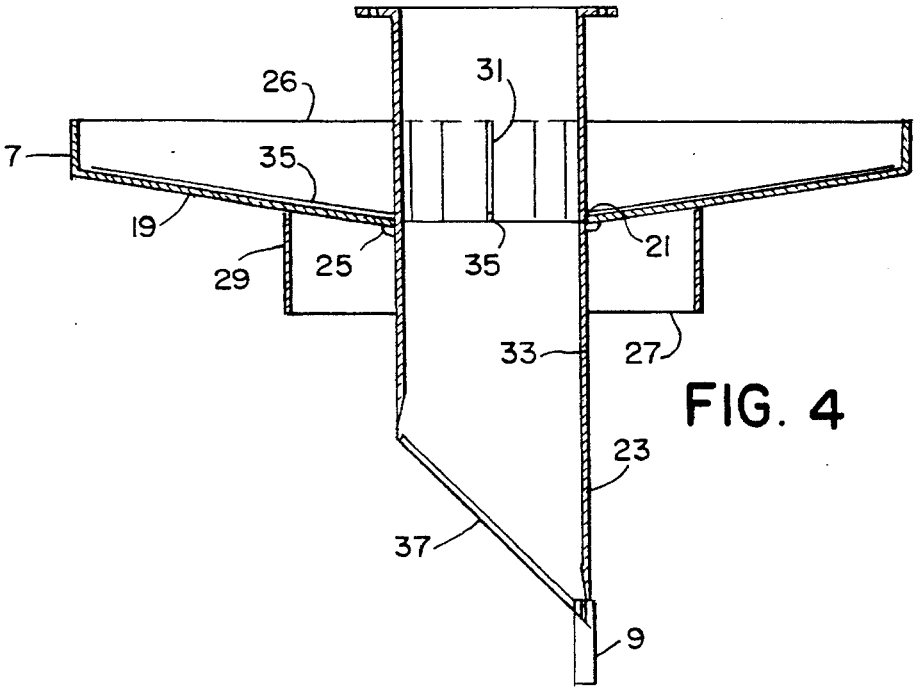
FIG. 4

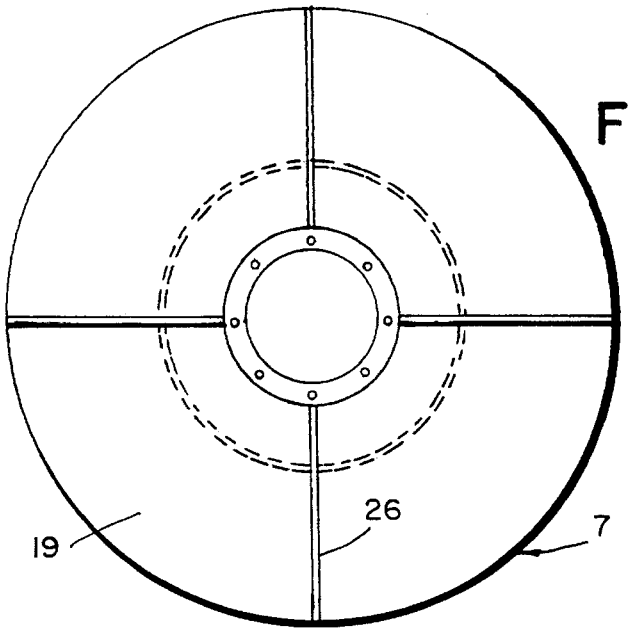
FIG. 5A
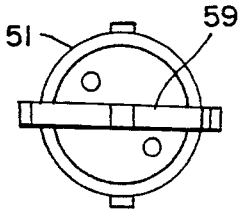
FIG. 6B
FIG. 5B
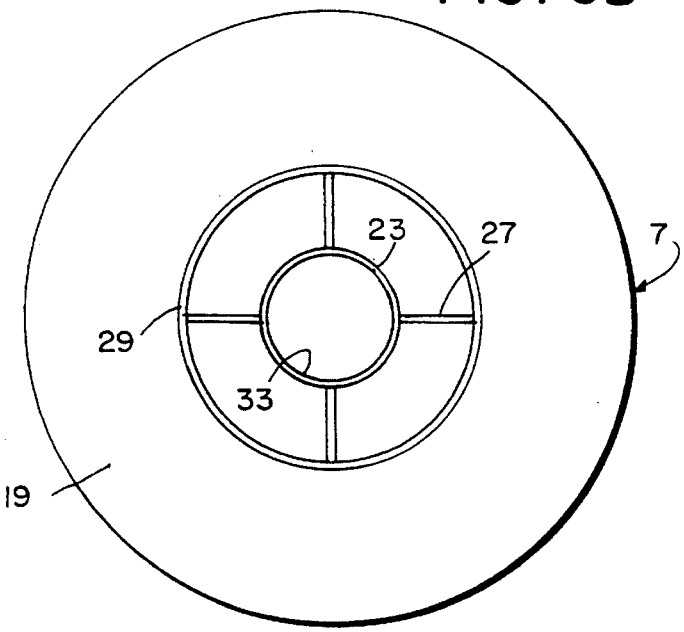
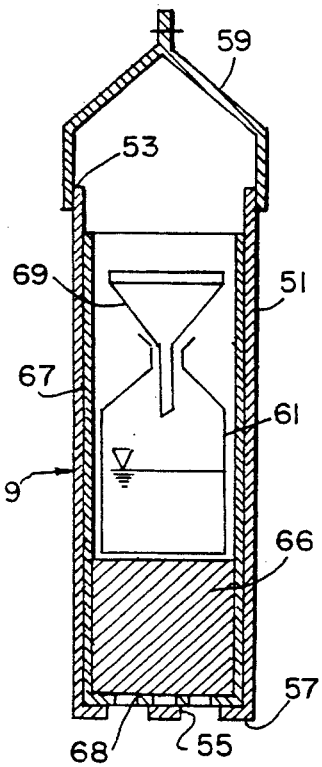
FIG. 6A

LYSIMETER FOR COLLECTING CHEMICAL SAMPLES FROM THE VADOSE ZONE

This application is a division of application Ser. No. 07/873,161 filed Apr. 24, 1992.

BACKGROUND OF THE INVENTION

This invention relates to a lysimeter probe that is a device used for measuring percolation of water through soils and sampling soil water for chemical analyses. A lysimeter is generally a tank or container inserted into the soil used to define the water movement across a soil boundary. The lysimeter of the present invention is especially designed for golf course groundwater monitoring; it monitors chemicals and groundwater recharge transmission to and in the groundwater.

A typical design consists of a porous cup attached to a PVC sample accumulation chamber and two access taps that lead to the soil surface.

Lysimeters have been used for over 300 years to determine water use by vegetation. Precision lysimetry for measuring evapotranspiration (ET) has developed mainly within the past 50 years. Weighing lysimeter designs are quite varied to suit individual research requirements. Surface areas from 1.0 meters to over 29 meters have been used. ET accuracy depends directly on the lysimeter area, mass, and the type of scale, but many lysimeters have accuracies better than 0.05 millimeters. Few weighing lysimeters exceed 2.5 meters profile depth. Mechanical, floating, hydraulic, and electronic scales have been used in weighing lysimeters with varying types of data recording methods. Lysimeter wall construction can affect heat transfer to the lysimeter and water flow along the walls. ET accuracy of weighing lysimeters can be affected by many additional factors (personnel traffic, cultural operations, crop height, etc.).

Lysimeters have become standard tools in evapotranspiration (ET) and water quality research. An excellent review of the history of evaporation research and experimental methods is found in Brutsaert (1982). Historical accounts of ET research, in particular lysimeter developments, are found in Kohnke et al. (1982). Soileau and Hauck (1987) reviewed lysimetry research with an emphasis on percolate water quality, and Bergstrom (1990) discussed lysimetry applications for pesticide leaching research.

Lysimeter is defined in Webster's *New Collegiate Dictionary* as a "device for measuring the percolation of water through soils and for determining the soluble constituent removed in the drainage". The word "lysimeter" is derived from the Greek words lysis which means dissolution or movement, and metron which means to measure. Clearly, the word lysimeter means the measurement of the percolation of water in soil, although other devices to remove water samples from soil are called "lysimeters". The water use (evaporation, transpiration, or ET) can be determined by a balance of the water above this boundary. Weighing lysimeters determine ET directly by the mass balance of the water, as contrasted to non-weighing lysimeters which indirectly determine ET by volume balance.

The first lysimeter for the study of water use has been attributed to De la Hire of France in the late 17th century. A lysimeter study was conducted in the Netherlands in early 17th century, probably about 1620, by Van Helmont. Principle advances in ET lysimetry have centered on the measurement of the lysimeter mass and vacuum drainage and deeper lysimeters to more closely duplicate field conditions. The weighing mechanisms—mechanical, floating, hydraulic, or electronic—can be automated for electronic data recording. Major advances have occurred in the past 20 years in recording weighing lysimeter data.

Lysimeter designs have been copied or duplicated. However, Kohnke et al. (1940) cautioned "that no one construction should be regarded as standard in a lysimeter and that a proper design can be made only by having an accurate knowledge of both the purpose of the experiment and of the pedologic, geologic, and climatic conditions". Pruitt and Lourence (1985) cautioned each lysimeter user to critically evaluate all agronomic aspects to ensure the representative high quality ET data since major errors in ET data are possible even with an accurate lysimeter.

In ET research, lysimeters are simply containers or tanks filled with soil in which plants are grown. Lysimeters have been classified according to type of soil block used, surface drainage, and methods of measuring soil water content. The method of drainage may be gravity or vacuum, or a water table may be maintained. Lysimeters for ET research are usually classified as monolithic or reconstructed soil profiles, as weighing or non-weighing, and as gravity or vacuum drainage.

Water percolating from the surface to the groundwater aquifer can carry pollutants in solution which may ultimately contaminate drinking water wells. In many instances, wells used to extract drinking water have been contaminated by agricultural chemicals and other pesticides used at the surface. Percolation takes a long time. Once aquifers are contaminated, cleaning them is a long term, expensive process. Early indications of potential contaminants can be obtained by sampling water from the soil a few feet below ground level before water reaches saturated levels. Lysimeters are used to sample water from the unsaturated vadose zone. The water pressure in the vadose zone is below atmospheric due to capillary effects. The suction effect produced by capillarity has to be overcome for successful water sampling from this zone. Lysimeters have mechanisms to achieve this for successful operation.

A need exists for a compact lysimeter which is accurate and easy to install and use. Additionally, a need exists for accurately collecting and measuring water moving through the vadose zone whereby a sample is suitable for trace containment analysis.

Golf courses and other operations that use chemicals need to sample concentrations of chemicals moving through the vadose zone. Currently a lysimeter device is not available to perform this type of measurement.

SUMMARY OF THE INVENTION

The present invention is especially designed to enable collection of chemicals moving through the vadose zone. In the present lysimeter capillary effect is produced by creating an artificial saturation area and a gravity flow using an arrangement of wicks made of materials such as glass fiber. The new lysimeter is able to trace contaminants that typically end up in golf course groundwater, which provides substantial value in assuring the public that health is not compromised from the operation of golf courses.

An object of the present invention is to expand on the conventional lysimeter to enable collection of contaminants from samples in the vadose zone. The preferred embodiment of the lysimeter has two major parts. The first part is a cylindrical sampling pipe connected to a lysimeter pan and a filter pack. A collection guide is wrapped around a collection container downward from the top of the pipe and extending underground. The second part is a large collector chamber housing part of the sampling pipe and collection container. Several components of the lysimeter are made of stainless steel or other material that is inert to the lychant. Basic construction elements include a sampling pipe, pan, screen, sampler, collection rod and collector chamber.

The pipe extends through the soil to the surface and terminates in a box, similar to a standard irrigation box. The top of the pipe is capped, and the box is provided with a lock to prevent contamination by surface water or vandals.

Below the pipe, a lysimeter pan is attached to the pipe with fine grid screens built around where the pan and pipe meet. The screens are designed to withstand a dead load produced by soil and water pressure at full saturation and a moving load, depending on the site selected. The screens allow water collected in the lysimeter pan to flow through the filter pack down into the sampling pipe and into the collection container. The filter pack is filled with a fine material, e.g. washed silica sand approximately 0.02 inches (0.5 mm) of median grain size. The grid size of the screen and the grain size of the filter pack material is determined from the characteristics of the soil layer lying on top of the filter pack. The filter pack is designed to minimize or prevent transformation of the lychant's chemical characteristics and to reduce as much as possible the collection of fine sediments in the lysimeter.

The lysimeter pan is shallow and wide; the width can vary, depending on the amount of lychant desired. The screens are approximately eight inches in height. A 0.5 inch diameter lip at the end of the pipe is constructed with an angle, e.g. a 45° angle facing the side of the pipe. A stainless steel or other inert material tube is connected to the end of the lip and extends into the collection container. The rolled lip and tube guide lychant into the collection container.

The collection container is made of an inert material, e.g. glass, and is housed in another container made of another inert material, e.g. 316 stainless steel. A collector guide is fastened to the side of the collector chamber to hold the collection container in place. The collection container is raised and lowered from the top through the sampling pipe by a collection rod. As an option, the collection container and rod can be outfitted with a transducer to measure weight of lychant collected in the collection bottle. Additionally, the collection chamber can be outfitted with a transducer to measure the amount of additional lychant collected in the collection chamber.

The lysimeter is installed at a depth of approximately 12 feet from the surface so that the collection interface is suitably located e.g. typically 5 to 6 feet below the surface, however, the lysimeter can be less than 12" below surface. A hole sufficiently large will be excavated in layers, and the lysimeter pan with the filter pack in place is installed so that all parts below the bottom of the lysimeter pan are bedded on packed silica powder or fine grained sand. Fine sand is placed in the hole so that the lower part of the lysimeter is completely embedded in it. A filter layer is placed in the lysimeter pan to reduce sediment collection in the pan, and to create adequate capillary forces such that streamlines characteristic of water movement through the vadose zone move parallel and into the lysimeter pan under most conditions. The space above the pan is filled with the excavated material in layers so that the soil profile is as close as possible to its original condition. The top end of the sampling pipe terminates at a container, such as irrigation-type box, which is secured against vandalism.

A lysimeter has an elongated, relatively narrow sample pipe with flanges at upper and lower ends. A lysimeter assembly is connected to the lower end of the sample pipe by connecting an upper end of a central tube in the assembly to a lower end of the central pipe. A circular lysimeter pan extends around the central tube. Vertical slits in the central tube provide a screen to permit water flow into the central tube from the pan, but to prevent passage of granular materials from the filter pack. Vertical webs in the pan rigidify the pan, and radial supporting webs and a ring beneath the pan further support the pan. A relatively large diameter collection chamber has a spheroidal lower end and an upper end which receives the ring for centering the lysimeter pan at the upper end of the collection chamber. An outward and upward sloping flange at an upper end of the collection chamber supports the lower conical wall of the lysimeter pan. A wick in the pan extends through slits in the central tube to wick water from the pan into the central tube and to flow water down along the inner wall of the central tube. The bottom of the central tube is open and is sloped, and an upward opening inner groove is formed around the lower end of the central tube. A drain tube is connected to a lower portion of the groove. A sampler is raised and lowered and positioned by a rod or chain extending through the sample pipe and central tube, so that a funnel or other device at the upper end of a flask is aligned with the drain tube. The flask is held supported on a foam block in the double wall canister. Drain openings can be provided in the canister bottom, or if recharge volumes are desired, a suitably selected transducer can be installed to measure the amount of water passing through the vadose zone collected by the lysimeter device in excess of water collected in the sampler collection device. Volume measurements can be provided mechanically or electrically. The canister is positioned under the drain tube and is held in place by fixing the upper end of the rod or chain within the sample pipe, which is capped between sampler positionings and removals and replacements.

A preferred lysimeter apparatus comprises an elongated sample pipe for positioning vertically in ground. A lysimeter pan extends horizontally from the sample pipe for collecting water moving through and into the ground. A collection chamber is positioned beneath the pan. A sampler is mounted beneath the pan for receiving water from the pan, and an elongated member extends upward from the sampler through the sample pipe for withdrawing and inserting the sampler in the collection chamber below the lysimeter pan.

A central tube is connected to a lower end of the sample pipe. The lysimeter pan is circular in planform with an inwardly sloping conical bottom, and a screen in the tube flows water, also referred to as lychant, from the pan into the sample tube for collection from the sample tube in the sampler.

The screen comprises vertical slits in the wall of the central tube for communicating the interior of the lysimeter pan with an interior of the central tube.

A wick is positioned in the bottom of the lysimeter pan and extends through the slits for flowing water through the slits and into the central tube by wicking action.

A filter pack within the lysimeter pan prevents flow of solids into the lysimeter pan.

A preferred embodiment has an open sloping lower end on the central tube and an inner upward opening groove along the sloping lower end of the central tube for collecting water flowing down an inner wall of the tube.

A drain is connected to a lower portion of the groove for draining water from the groove, and the sampler is positioned beneath the drain.

Radially extending upper webs are positioned in the lysimeter pan for supporting the pan, and radially extending lower webs extend from the central tube along the bottom of the pan for supporting the pan. A ring surrounds outer edges of the lower radially extending webs for supporting and rigidifying the pan.

The collection chamber comprises a relatively large downward extending cylinder having a spheroidal bottom and having an open upper end for receiving the ring, and an upper outwardly sloping flange on the upper end of the collection chamber for supporting the bottom of the lysimeter pan.

The sampler comprises a sterile flask having an upper opening, a funnel positioned in the opening, and a perforated block positioned beneath the flask. The inner canister has a circular side wall and a bottom wall and has drain openings in the bottom wall. An outer canister surrounds the inner canister, and has a cylindrical outer wall and a circular bottom wall and may have drainage holes in the circular bottom wall if recharge measurements are not desired. A holder is connected to the upper end of the outer canister and an attachment at an upper end of holder lifts and lowers the sampler.

The preferred method of installing and using a lysimeter comprises excavating in layers a large opening about four feet in diameter and about twelve feet deep, and placing finely grained material in a bottom of the opening. A cylindrical collection chamber is placed having a spheroidal bottom wall on the finely grained material, which supports a circular lysimeter pan having a conically shaped bottom on a sloping upper flange of the collection chamber. A filter pack is placed in the lysimeter pan. A sample pipe is mounted on a central tube of the lysimeter pan, and the sample pipe is extended to the surface. The excavated earth is backfilled in similar layers over the lysimeter pan around the sample pipe. A sampler is inserted through the sample pipe and central tube and the sampler is positioned at a lower end of the central tube. Lychant liquids flow through the backfilled earth and filter pack to a wick at the bottom of the lysimeter pan. Lychant liquids flow through the wick and through openings in the central tube, and down along an inner wall of the central tube. Lychant liquid is collected in a sloped upward opening groove along an open lower sloping edge of the central tube. Lychant liquid flows from the groove through a drain tube, through a funnel and into a collection flask. The sampler is lowered from its position adjacent to the drain tube, disengaging the sampler from the drain tube and centering the sampler and raising the sampler through the central tube and sample pipe. Characteristics of the water from the sample flask are measured. The flask is sterilized and replaced in the sample. The sampler is lowered through the sampler pipe and central tube, and is positioned beneath the drain tube, and an upper end of the sample pipe is closed.

These and further and other objects and features of the invention are apparent in the disclosure, which includes the above and ongoing written specification, with the claims and the drawings.

BRIEF DESCRIPTION OF THE DRAWINGS

FIGS. 3A and 3B illustrate the top and cross-section of the collector chamber.

FIG. 4 illustrates a cross-section view of the lysimeter pan.

FIG. 5A illustrates a top view, and FIG. 5B illustrates the underside view of the pan.

FIGS. 6A, 6B and 6C illustrate detailed cross-section views of the sample collector.

DETAILED DESCRIPTION OF THE DRAWINGS

Figure 1:
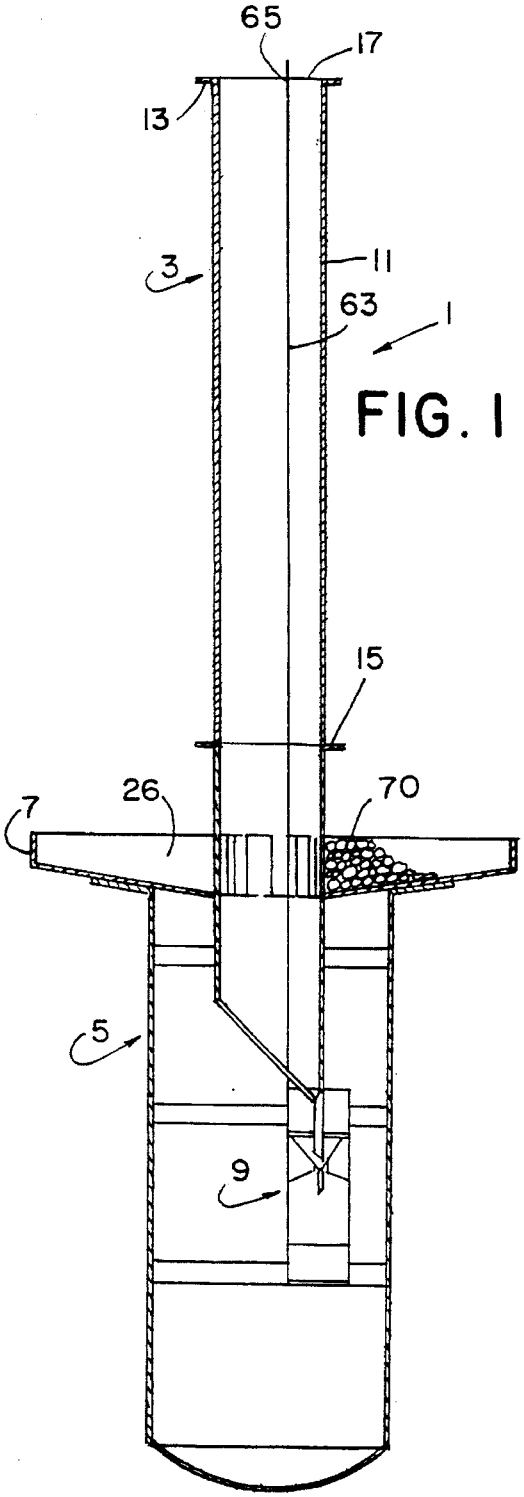
FIG. 1 illustrates the cross-section of the assembled lysimeter.

Referring to FIG. 1, four main components of the lysimeter 1 are the sample pipe 3, collection chamber 5, lysimeter pan 7, and the sampler 9.

Figure 2B:
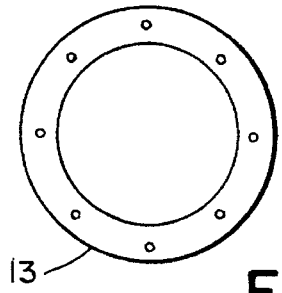
FIGS. 2A and 2*b* illustrate the sampling pipe.
Figure 2A:
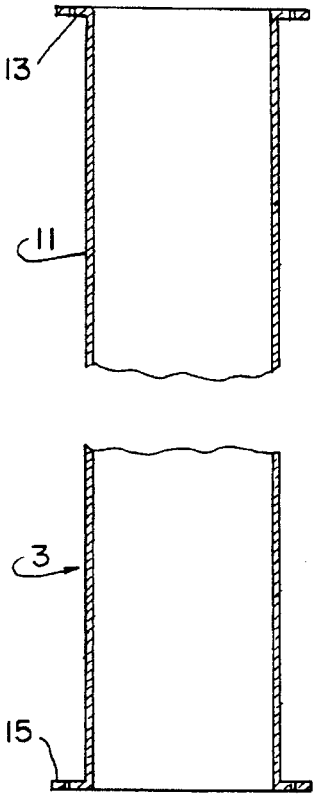

The preferred sample pipe 3, shown in FIGS. 2A and 2B, is a tube 11 that is five feet nine inches long, depending on the site, with flanges 13 and 15 at both ends for connecting purposes. The tube is ten inches in diameter and is made of either stainless steel or inert plastic. The thickness of the tube is designed to withstand soil pressure at the design depth. The sample tube 3 is connected to the lysimeter pan assembly 7 through the lower flange 15. The instrument is sealed at the top using a flat plate 17 or some other similar device bolted to the flange.

The lysimeter pan 7 is the most important component of the lysimeter assembly 1. Pan 7 made of stainless steel is shown in FIG. 4. The pan assembly is 3 to 4 feet in height. The bottom 19 of the pan 7 is shaped like a frustum of a cone and slopes towards the center 21. A stainless steel tube or other inert material 23 ten inches in diameter passes through the pan 7 and is attached 25 rigidly to the pan at the circumference of the tube and is stiffened by radial webs 26 connected to the inside of the pan. Short outer support webs 27 are surrounded by ring 29, which fits within the top of the collection chamber 5, as shown in FIGS. 4, 5A and 5B. Openings 31 in the shape of slots are cut upward from the line where the pan meets the tube. These slots lead the water from the pan to the inside 33 of the tube.

In one embodiment, the pressure gradient necessary is provided by the filter pack assembly which consists of a fiber wick 35 and fine grain size silica sand inside pan 7, which enters from the bottom of the pan through the slots to the open tapered end 37 of the tube. Water from the pan is led into the sampler through this wick.

The collector chamber 5, shown in FIG. 3, is an approximately 2 foot diameter cylindrical vessel 41 five feet five inches long, reinforced by inward formed two inch rings 45 on sixteen inch centers and closed at the lower spheroidal end 45. A lip 47 is formed at the open end at the top for the lysimeter pan to rest during operation. This point is made water-tight using a ring 49 of rubber, teflon or some similar material.

Figure 6C:
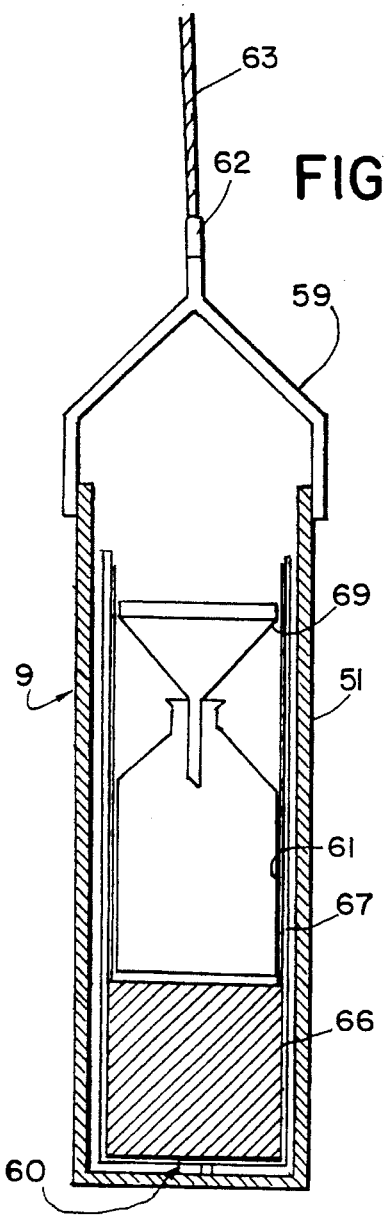

The sampler 9, shown in FIGS. 6A and 6B, is a six inch diameter stainless steel canister 51, twenty inches long and fully open at the top 53, with one inch diameter holes 55 in the bottom 57. An arched holder 59 is attached to the top 53 of the canister 51. The sample bottle 61 rests in the canister 51, and the assembly 9 is suspended by a stainless steel chain or rod 63 from the top of the sample tube 3. The chain or rod 63 may be attached to the top of the holder 59, or the rod may be welded to an outside of canister 51. The sampler 9 and sample bottle 61 are lowered into the correct position for operation, and the sample is withdrawn by lowering and lifting the sampler 9 through the sample tube 3 using the chain 63. The chain is fixed 65 at the top end of the sample tube during collection period. The sample bottle 61 is supported on a perforated block 66 within an inner holder 67 with openings 68 in its bottom. A funnel 69 leads water into the bottle 61. As shown in FIG. 6C, transducer 60 positioned between the holder 67 and canister 51 transmits data on the weight or mass of lychant collected in the sample bottle 61 and in the holder 67. The pressure transducer 60 measures the mass or weight of all lychant within the bottle 61. Alternatively, transducer 62 measures the weight or mass of all lychant within the canister 51 and sample bottle 61. As shown in FIG. 3A, an additional pressure transducer 64 at the bottom 45 of the collector chamber 5 measures the weight or mass of lychant within the collector chamber.

The whole assembly 1, as shown in FIG. 1, is buried in the ground where sampling has to be made. A filter pack 70 of appropriate grain size is installed inside the lysimeter pan. Backfill is made with the soil that has been excavated so that initial core conditions are maintained as closely as possible. Water percolating from the ground surface encounters the flat conical impermeable plate 19 and forms a saturated zone due to perching. Water so collected will be sucked through the glass fiber wick 35 lying in the bottom of the pan through the slots 31 and down the inner surface 33 of the lysimeter pan central tube 23. This water will finally reach the lip 37 of the tube, FIGS. 7A and 7B, and the sloping groove cut 75, and will drip into the sampler 9.

Figure 7A:
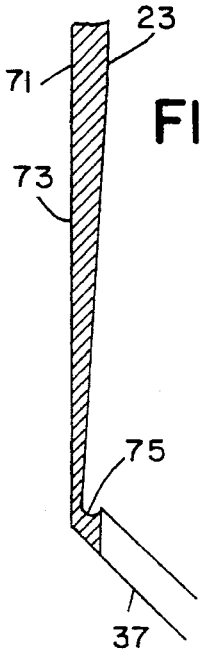
FIGS. 7A and 7B illustrate detailed views of the lip grove and lip drain.
Figure 7B:
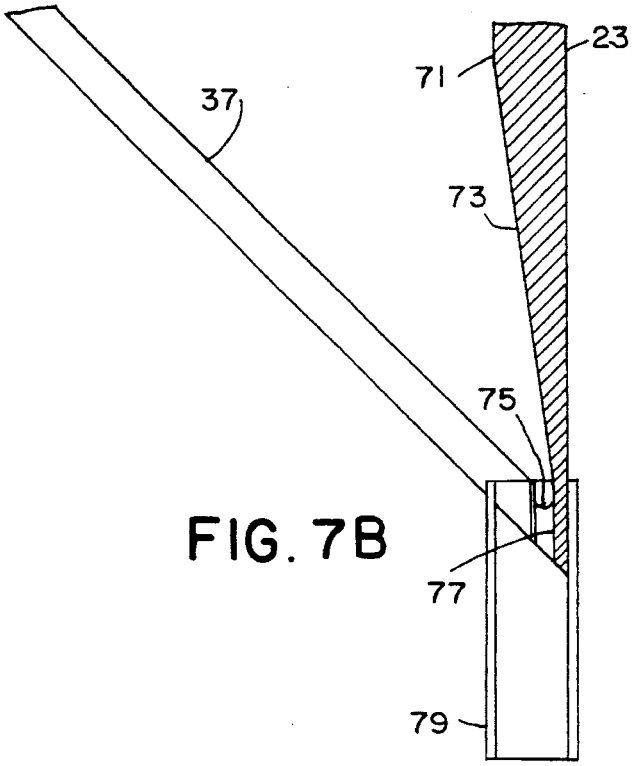

As shown in FIGS. 7A and 7B, a lower portion 71 of the inner wall 33 of the tube 23 is tapered downwardly and outwardly 73, and is grooved or rolled inward at the open tapered lower end 37 to form a lip groove 75. At the lowest point in the grove 75, a hole 77 is drilled from the lower edge to the lip groove to drain fluid moving downward along the wall 33 from the wick 35. A lip drain tube 79 is welded to the tube 23 around the hole 77. The sampler will be removed at regular intervals and replaced with a sterilized bottle 61 each time. The collection chamber will collect any excess water and will be pumped clean as and when necessary.

While the invention has been described with reference to specific embodiments, modifications and variations of the invention may be constructed without departing from the scope of the invention, which is defined in the following claims.

We claim:

1. The method of installing and using a lysimeter, comprising excavating a large opening about four feet in diameter and about twelve feet deep, placing finely grained material in a bottom of the opening, placing a cylindrical collection chamber having a spheroidal bottom wall on the finely grained material, supporting a circular lysimeter pan having a conically shaped bottom on a sloping upper flange of the collection chamber, placing a filter pack in the lysimeter pan, mounting a sample pipe on a central tube of the lysimeter pan and extending the sample pipe to the surface, backfilling the excavated earth over the lysimeter pan around the sample pipe, inserting a sampler through the sample pipe and central tube and positioning the sampler at a lower end of the central tube, flowing water through the backfilled earth and filter pack to a wick at the bottom of the lysimeter pan, flowing water through the wick and through openings in the central tube, flowing water down along an inner wall of the central tube, collecting water in a sloped upward opening groove along an open lower sloping edge of the central tube, flowing water from the groove through a drain tube, through a funnel and into a collection flask, lowering the sampler from its position adjacent to the drain tube, disengaging the sampler from the drain tube, centering the sampler and raising the sampler through the central tube and sample pipe, measuring characteristics of the water from the flask, sterilizing the flask and replacing the flask in the sampler, lowering the sampler through the sample pipe and central tube, and positioning the sampler beneath the drain tube and closing an upper end of the sample pipe.

2. A method of installing and using a lysimeter, comprising excavating an opening, placing material in a bottom of the opening, placing a collection chamber having a base on the material, placing a lysimeter collector having a downwardly sloped bottom on a sloping surface above the collection chamber, placing a filter pack in the lysimeter collector, mounting a collection tube in the lysimeter collector and extending a sample pipe from the chamber to the surface, backfilling the excavated earth over the filter pack on the lysimeter collector and around the sample pipe and the collection tube, positioning a sampler at a lower end of the tube, flowing water through the backfilled earth and filter pack and collecting lychant in the lysimeter collector, flowing the lychant through openings in the tube, flowing the lychant downward in the tube, collecting lychant from the tube, flowing the lychant into a collection flask, raising the flask through the tube and the sample pipe, measuring characteristics of the lychant from the flask, sterilizing the flask and replacing the flask by lowering the flask through the sample pipe and the tube, and positioning the sampler beneath the tube and closing an upper end of the sample pipe.

* * * * *